US005820480A

United States Patent [19]

Cheng

[11] Patent Number: 5,820,480

[45] Date of Patent: Oct. 13, 1998

[54] GOLF CLUB SHAFT AND METHOD OF MAKING THE SAME

[75] Inventor: Michael H. L. Cheng, Simi Valley, Calif.

[73] Assignee: Harrison Sports Inc., Pacoima, Calif.

[21] Appl. No.: 787,141

[22] Filed: Jan. 22, 1997

[51] Int. Cl.[6] ..... A63B 53/10

[52] U.S. Cl. ..... 473/289; 473/319

[58] Field of Search ..... 473/316–323, 473/287, 289, 292

[56] References Cited

U.S. PATENT DOCUMENTS

| | | | |
|---|---|---|---|
| 2,040,540 | 5/1936 | Young . | |
| 2,050,554 | 8/1936 | Barnhart . | |
| 2,086,275 | 3/1937 | Lemmon . | |
| 2,100,307 | 11/1937 | McMinn | 473/316 |
| 2,250,428 | 7/1941 | Vickery . | |
| 3,063,275 | 10/1962 | Reid | 473/318 |
| 3,614,101 | 10/1971 | Hunter . | |
| 3,871,649 | 3/1975 | Kilshaw | 473/289 |
| 4,169,595 | 10/1979 | Kaugars . | |
| 4,205,845 | 6/1980 | Kanne . | |
| 4,288,075 | 9/1981 | Kaugars et al. . | |
| 4,330,126 | 5/1982 | Rumble . | |
| 4,431,187 | 2/1984 | Rumble et al. . | |
| 4,555,112 | 11/1985 | Masghati . | |
| 4,757,997 | 7/1988 | Roy | 473/319 |
| 5,018,735 | 5/1991 | Meredith | 473/318 |
| 5,265,872 | 11/1993 | Tennent et al. . | |
| 5,316,299 | 5/1994 | Feche et al. . | |
| 5,695,408 | 12/1997 | DeLaCruz | 473/300 |

*Primary Examiner*—Sebastiano Passaniti
*Assistant Examiner*—Stephen L. Blau
*Attorney, Agent, or Firm*—Oppenheimer Wolff & Donnelly LLP

[57] ABSTRACT

A golf club shaft including a tip section, a grip section, and a main body section extending from the proximal end of the tip section to the distal end of the grip section. The slope of a first portion of the outer surface of the main body wall is different than the slope of a second portion.

14 Claims, 4 Drawing Sheets

GOLF CLUB SHAFT AND METHOD OF MAKING THE SAME

BACKGROUND OF THE INVENTION

1. Field of Invention

The present invention relates generally to golf clubs and, more particularly, to golf club shafts.

2. Description of the Related Art

Over the years, many substitutes have been introduced for the hard wood shafts originally used in golf club drivers and irons. Early substitute materials included stainless steel and aluminum. More recently, carbon fiber reinforced resin shafts have become popular. Fiber reinforced resin shafts are typically hollow, round in cross-section, and consist of a shaft wall formed around a tapered mandrel. The mandrel actually consists of three mandrel sections. The first mandrel section forms the tip, the second mandrel section forms the main body portion, and the third mandrel section forms the grip. As shown in FIG. 1, shafts formed in this manner have a constant taper from the tip/main body portion intersection to the main body portion/grip intersection. In other words, the taper of the main body portion is constant. Additionally, in order to reduce the weight of the shaft, the shaft wall thickness in conventional shafts tends to decrease uniformly (i.e. at a constant rate without abrupt changes) from the tip/main body portion intersection to the main body portion/grip intersection.

The use of fiber reinforced resin has allowed golf club manufacturers to produce shafts having varying degrees of torsional and longitudinal stiffness to satisfy the needs of a wide variety of golfers. Torsional stiffness relates to a golf club's ability to resist twisting along its length when a golf ball is struck. The inertia of the ball produces a force on the head tending to rotate the head about the axis of the shaft relative to the grip section. Longitudinal stiffness refers to the amount of bending the shaft of a golf club undergoes when subjected to a force.

For a given grip outer diameter (OD) and a given tip OD, the conventional method of increasing the torsional and longitudinal stiffness of a fiber reinforced resin shaft is to increase the thickness of the shaft wall. However, because the fiber reinforced resins used to make the shaft are expensive, the use of additional material to increase the shaft wall thickness raises the cost of the shaft to an undesirable level. Additionally, increasing the shaft wall thickness adds weight to the shaft, which is also undesirable. Another method of increasing torsional and longitudinal stiffness is to use materials with a higher modulus of stiffness. Due to the relatively high cost of these materials, this method is also undesirable.

SUMMARY OF THE INVENTION

Accordingly, the general object of the present invention is to provide a golf club shaft which avoids, for practical purposes, the aforementioned problems. In particular, one object of the present invention is to provide a golf club shaft which has greater longitudinal and torsional stiffness than conventional shafts with the same tip OD and grip OD. Another object of the present invention is to provide a golf club shaft which has greater longitudinal and torsional stiffness than conventional shafts with the same tip OD and grip OD without substantially increasing the weight of the shaft. Still another object of the present invention is to provide a method of manufacturing golf club shafts which allows the longitudinal and torsional stiffness to be easily varied for a given tip OD and grip OD without substantially varying the weight of the shaft.

In order to accomplish these and other objectives, a golf club shaft in accordance with a preferred embodiment of the present invention includes a tip section, a grip section, and a main body section extending from the proximal end of the tip section to the distal end of the grip section. The slope (or taper) of a first portion of the outer surface of the main body wall is different than the slope of a second portion. Thus, the outer diameter of the main body wall can be made larger (or smaller) than that of a shaft with a constant slope between the tip section and the grip section.

The present invention provides a number of advantages over the prior art. For example, the present invention provides greater longitudinal and torsional stiffness than a conventional shaft with the same tip OD and grip OD or, if desired, reduced longitudinal and torsional stiffness. Moreover, the present invention does so without increasing the weight of the shaft.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 2:
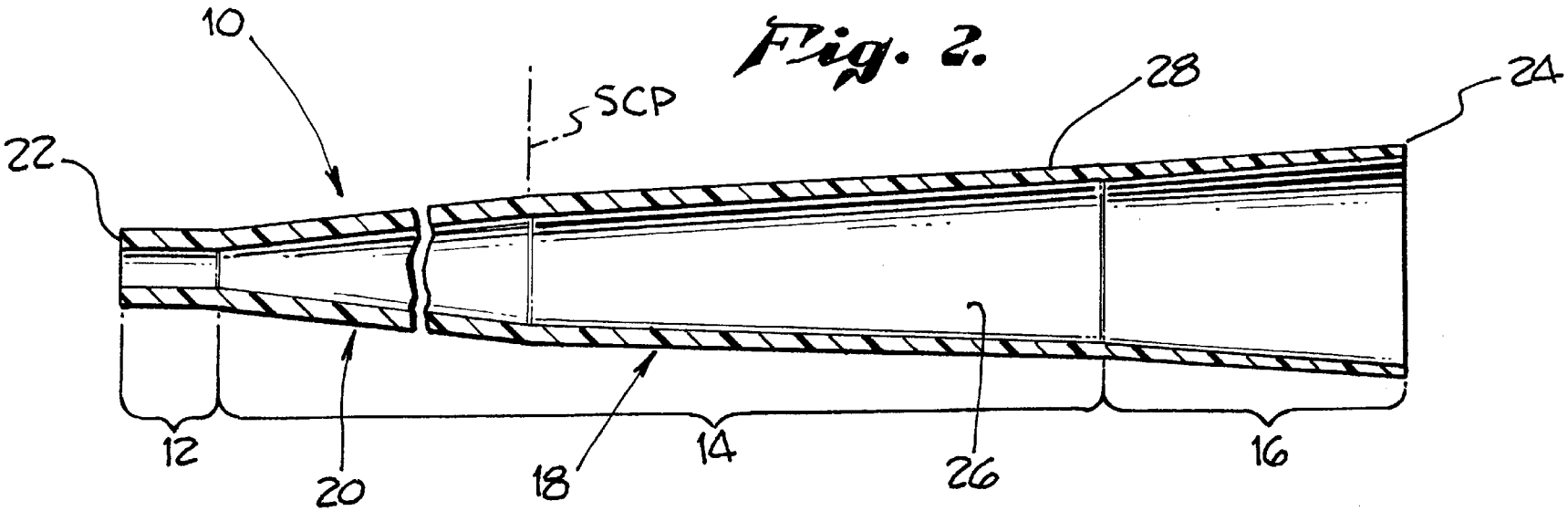
FIG. 2 is a section view of a golf club shaft in accordance with a preferred embodiment of the present invention.

As illustrated for example in FIG. 2, a golf club shaft 10 in accordance with a preferred embodiment of the present invention includes a tip section 12, a main body 14, and a grip section 16. The main body 14 has at least a first (or proximal) main body section 18 adjacent to the distal end of the grip section 16 and a second (or distal) main body section 20 adjacent to the proximal end of the tip section 12. Although the taper of the grip section 16 is preferably greater than that of the first main body section 18 (as shown), the taper of the grip section may be the same as, or less than, the taper of the first main body section if desired. The first and second main body sections define different tapers with respect to the longitudinal axis of the shaft. As such, the taper of the main body 14 is not constant. The shaft 10 has a tip 22 (at the distal end of the shaft) and a butt 24 (at the proximal end of the shaft) between which the overall length of the shaft 10 is defined. The shaft 10 is also hollow and has an inner portion 26 defined by a wall 28. Preferably, the wall thickness of the shaft decreases at a substantially constant rate from the tip to the buff.

It should be noted that the dimensions of the shaft 10 illustrated in the drawings are exaggerated, specifically highlighting and distinguishing the differences in the degree of the respective slopes of the first and second main body sections 18 and 20. In a commercial embodiment of the shaft, the transition points between adjacent sections of the shaft 10 (as indicated by dashed lines) are marked with only a slight inflection between the slopes, particularly at the junction of the first and second main body sections.

Figure 1:
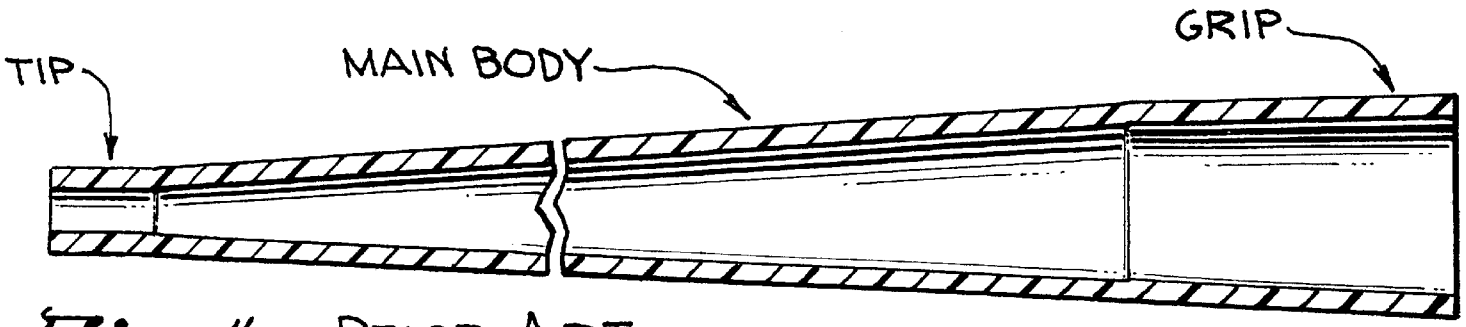
Fig. 1. PRIOR ART
FIG. 1 is a section view of a conventional shaft.
Figure 3:
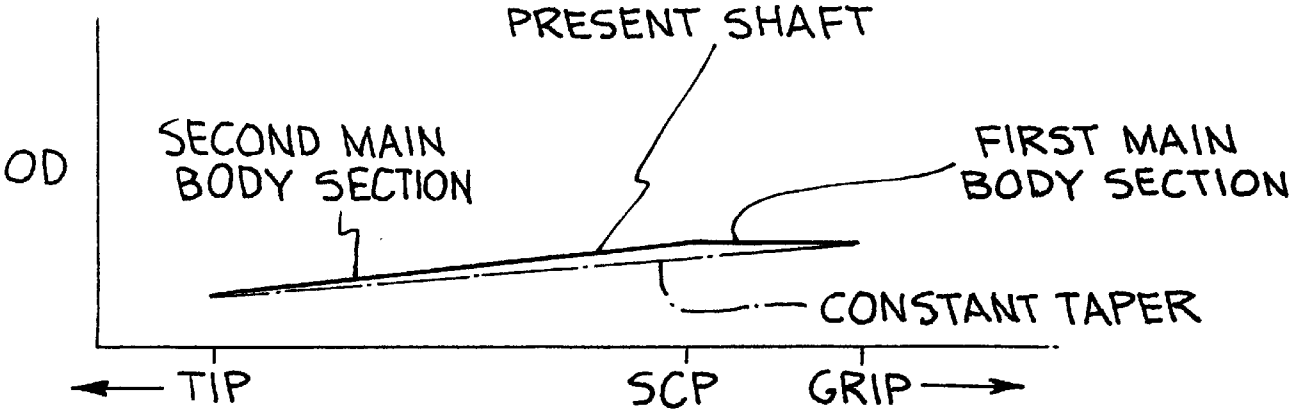
FIG. 3 is a graphical comparison of the present golf club shaft to a conventional shaft.
Figure 4:
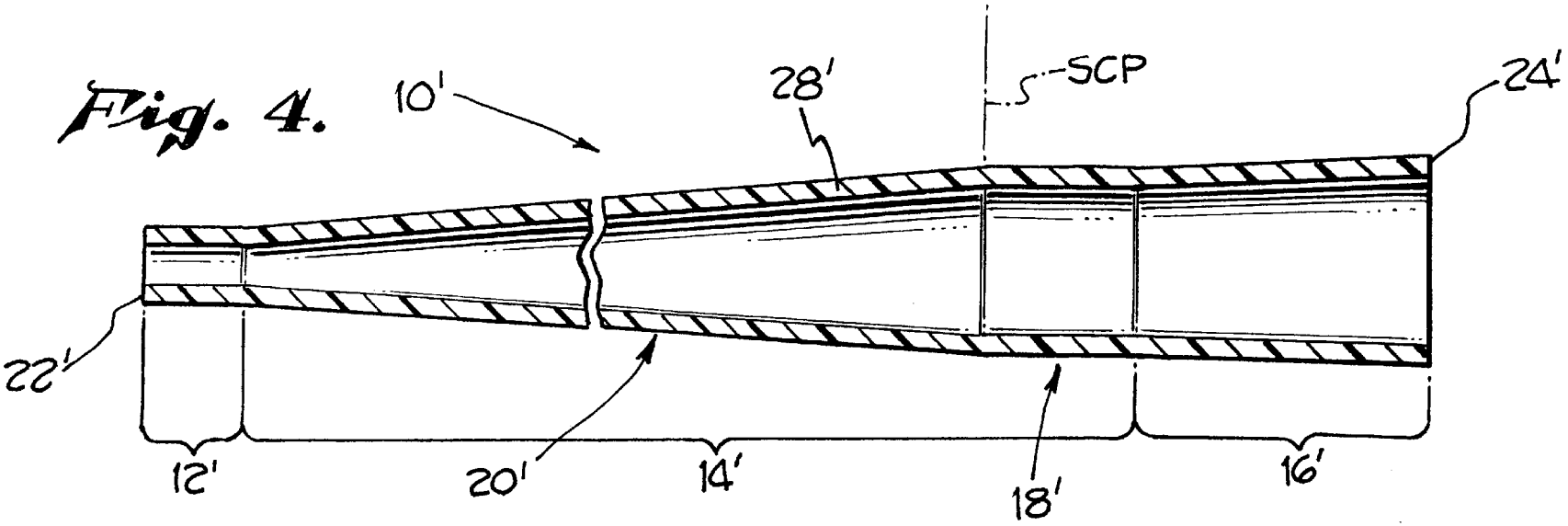
FIG. 4 is a section view of a golf club shaft in accordance with another preferred embodiment of the invention.

The longitudinal and torsional stiffness of the present shaft 10 may be adjusted by varying the location and magnitude of a stiffness control point (SCP). The SCP is located at the intersection of the first main body section 18 and the second main body section 20. As illustrated for example in FIG. 3, the OD of the present main body 14 is increased along its entire length, as compared to the OD of a constant tapered main body section (shown in dashed lines), with the maximum OD increase being at the SCP. As a result of the increase in OD along the main body 14, the shaft 10 shown in FIG. 2 will have greater longitudinal and torsional stiffness than the conventional shaft shown in FIG. 1 for a given wall thickness, tip/main body intersection OD, and main body/grip intersection OD. Conversely, in order to reduce the stiffness of a shaft, the OD may be decreased along the length of the main body 14, as compared to a constant taper, with the point of maximum decrease in OD being at the SCP. The location and magnitude of the SCP may be varied as desired. For example, as shown FIG. 4, the SCP may be located relatively close to the grip section 16' and the magnitude of the SCP may be such that the OD of the first main body section 18' is equal to that of the main body/grip intersection. Thus, the first main body section 18' has little to no taper (or slope). The OD at the SCP may also be greater than the OD at the main body/grip intersection or the OD at the butt.

Generally speaking, for a SCP of a given magnitude, the farther the SCP is from the main body/grip intersection, the stiffer the shaft. This is because moving the SCP farther from the main body/grip intersection increases the length of the first main body section 18, which has a larger diameter than the second main body section 20.

Figure 5:
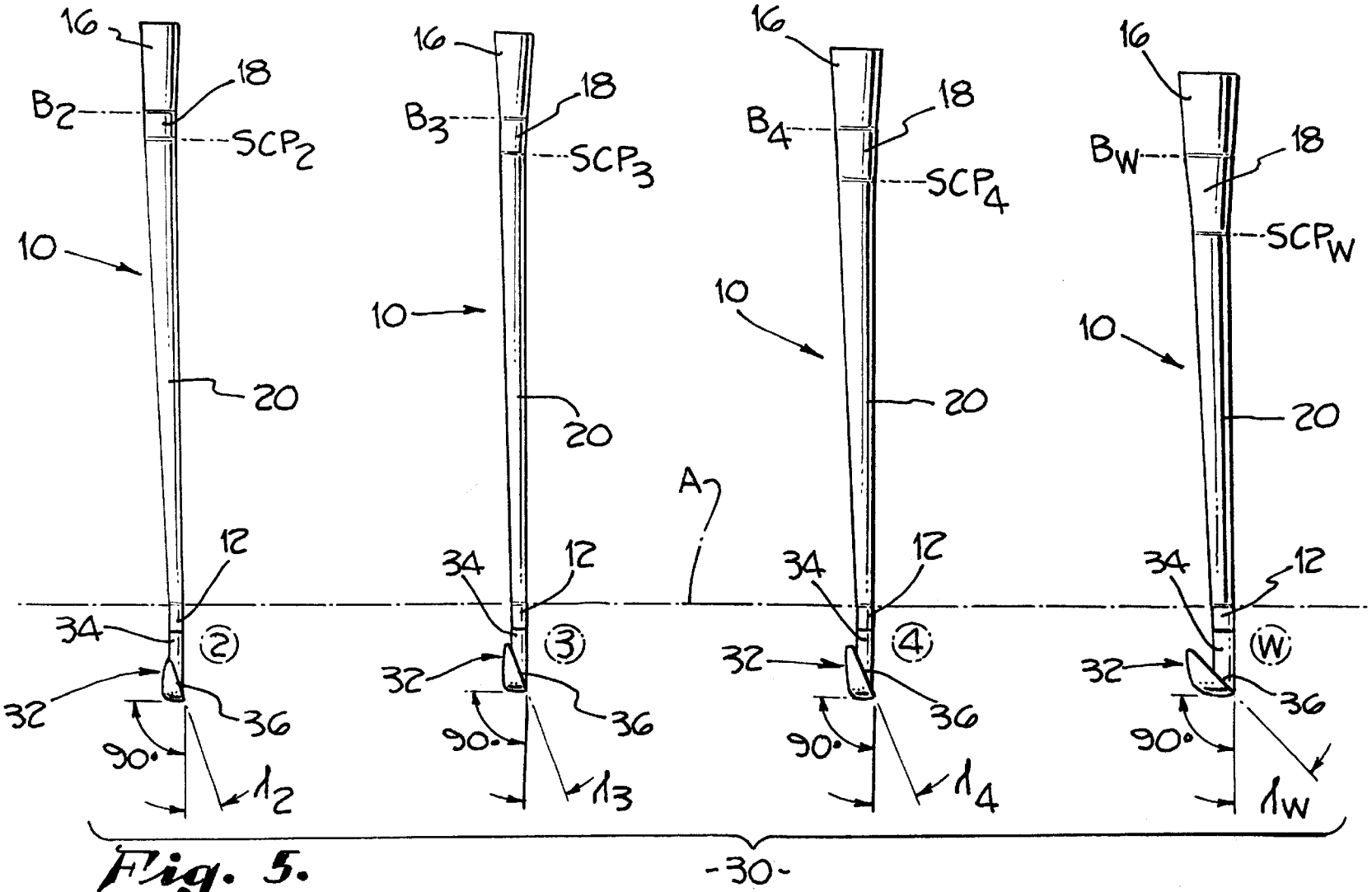
FIG. 5 is a plan view of a set of golf clubs in accordance with the present invention.

An exemplary set of golf clubs 30 in accordance with the present invention is shown in FIG. 5. Each of the clubs includes a shaft 10, such as that shown in FIG. 2, and a head 32 having a hosel 34 to which the tip section 12 is attached. The heads also have faces 36 with a distinctive loft defined by angle $\lambda$ and each club has a number, i.e., 2, 3, 4, . . . W (wedge), indicative of the loft. The greater the loft, the larger the angle $\lambda$, and the higher the number of the club. Although a set of woods may also be produced, each of the clubs 30 shown in FIG. 5 is an iron. The set of irons includes a 2-iron (which has the smallest degree of loft indicated by $\lambda_2$), a 3-iron, and so on up to a pitching wedge (which has the largest degree of loft indicated by $\lambda_w$).

Each head 32 has a particular weight and the weight increases, preferably by 7 grams per club, as the loft of the face 36 increases. Accordingly, the 2-iron has the lightest head and the pitching wedge has the heaviest head. In order to compensate for the increased weight of the heads 32, the shafts 10 are progressively shortened to increase the shaft stiffness. The length of each exemplary main body shown in FIG. 5 (the distance between dashed line A and dashed lines $B_2$, $B_3$, $B_4$, . . . $B_w$) decreases from the 2-iron to the pitching wedge. The length of the tip section 12 and the length of the grip section 16 in the exemplary set are substantially constant from club to club.

In accordance with the present invention, the stiffness of the shafts 10 may be further varied by varying the location and/or magnitude of the SCP. For example, the exemplary 2-iron SCP is closer to the grip section than the exemplary 3-iron SCP which, in turn, is closer to the grip section than the exemplary 4-iron SCP, and so on. As discussed above, increasing the distance between the SCP and the grip section increases shaft stiffness. Therefore, the shaft stiffness of each club in the exemplary set is greater than that of the prior club. The differences in shaft stiffness are over and above those resulting from differences in club length.

A commercial embodiment of a shaft 10 in accordance with the present invention may be configured as follows. The overall length of the shaft may range from 33 inches to 44 inches. With respect to the tip section 12, the length may range from about 3 inches to 7 inches and the OD may range from about 0.370 inch to 0.395 inch for irons. The tip section OD is about 0.335–0.350 inch for woods. The length of the grip section 16 may range from about 6 inches to about 10 inches. The exemplary grip section tapers from an OD of about 0.81–1.00 inch at the butt 24 to an OD of about 0.55 inch to 0.70 inch at the grip/main body intersection. The wall thickness of the main body portion preferably decreases at constant rate from a thickness of between 1.5 mm and 2.1 mm at the intersection with the tip section to a thickness of between 0.7 mm to 1.8 mm at the intersection with the grip section. The SCP in the exemplary commercial embodiment may be located from about 3 inches to 12 inches from the grip/main body intersection. In other words, the first main body section 18 ranges from approximately 5% to 36% of the total shaft length. With respect to SCP magnitude, the OD of the shaft at the SCP generally depends on the location of the SCP. In the exemplary commercial embodiment, the OD of the shaft at the SCP may be substantially equal to the OD at the grip/main body intersection when the SCP is relatively close to the grip/main body intersection. [Note FIG. 4.] If the SCP is relatively far from the grip/main body intersection, the OD at the SCP may range from about 0.45 inch to 0.53 inch.

Turning to manufacturing, the shaft wall 28 may be formed by wrapping multiple layers (typically 10–20 layers) of a fiber reinforced resin composite over a mandrel until the desired thickness is obtained. The fibers of each successive layer are preferably oriented at different angles with respect to the longitudinal axis of the shaft. The fibers of some layers may be parallel to the longitudinal axis, while the fibers of other layers are angled from 30–90 degrees with respect to the longitudinal axis. It should be noted, however, that the fibers of successive base rod layers, such as the outer layers, may be parallel to one another. Other layer combinations are also possible. For example, the first 5 to 10 layers may be alternating angled layers, and the next 5 to 10 layers may be parallel to the longitudinal axis.

Figure 6:
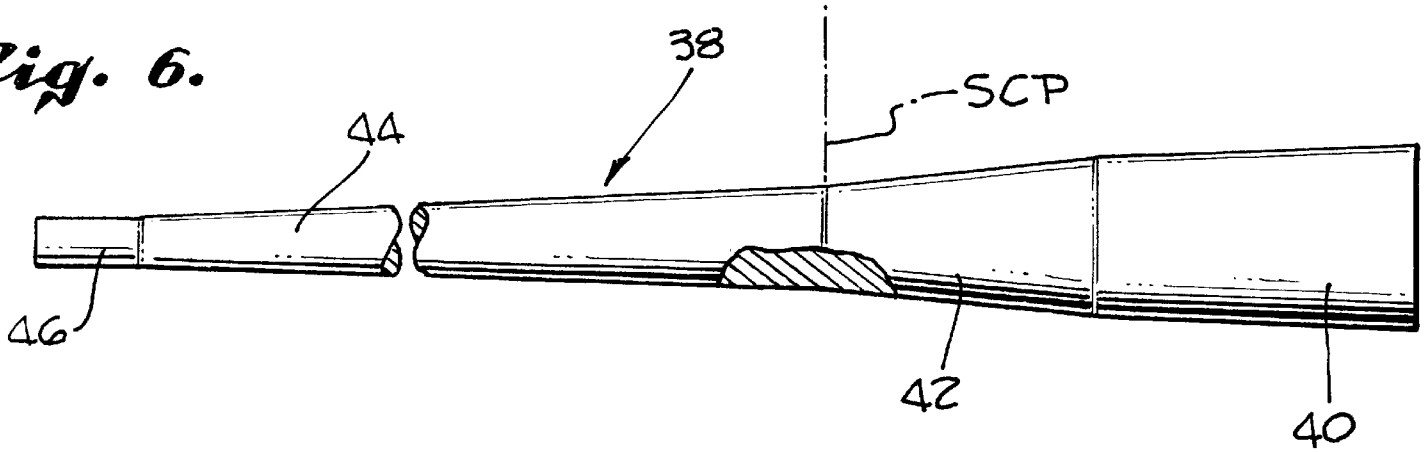
FIGS. 6 and 7 are plan views of mandrels in accordance with the present invention.
Figure 7:
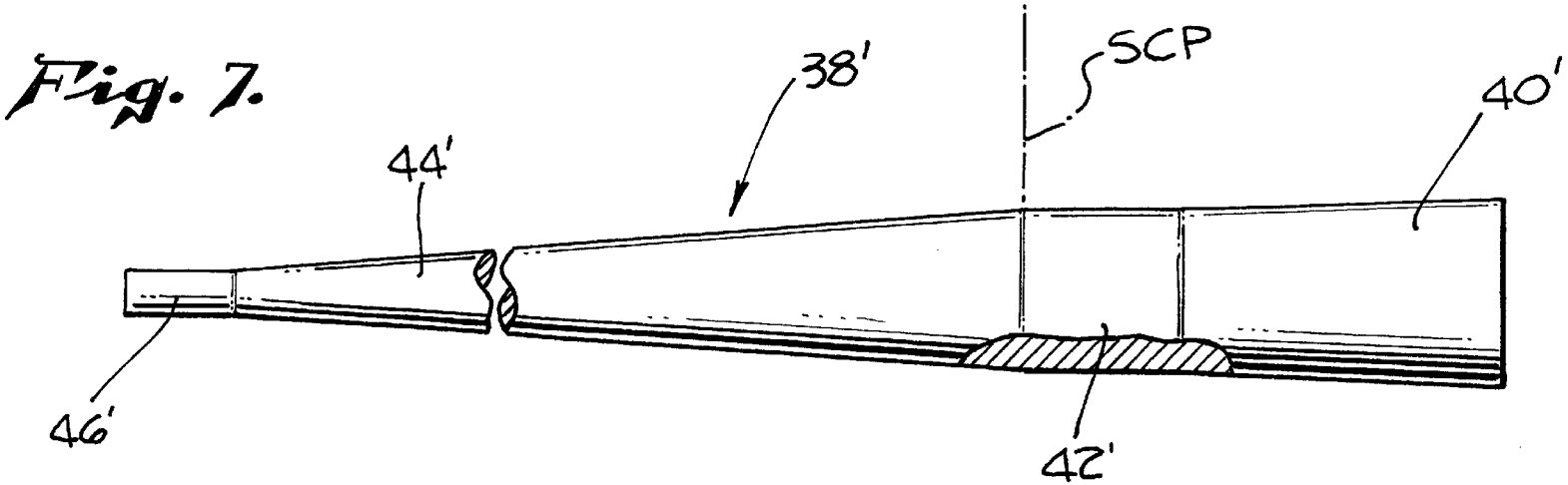

A mandrel 38 in accordance with a preferred embodiment of the present invention is illustrated in FIG. 6. The mandrel 38 consists of a grip section 40, a first tapered main body section 42, a second tapered main body section 44, and a tip section 46. The mandrel sections may be joined to one another in the conventional manner. The tapers of the first and second main body sections 42 and 44 are different. The SCP of the club produced by the mandrel 38 will be located at the intersection of the main body sections 42 and 44. As shown in FIG. 7, the respective tapers and lengths of the main body sections 42 and 44 may be varied in order to vary the location and magnitude of the SCP. A manufacturer who is practicing the present invention would have a number of each of the mandrel sections 40, 42, 44 and 46 to select from. The mandrel sections may be mixed and matched in order to provide the desired stiffness.

The present invention may be practiced with any of the materials typically used to produce composite resin/fiber golf club shafts. Suitable resins include, for example, thermosetting resins or polymers such as polyesters, epoxies, phenolics, melamines, silicones, polyimides, polyurethanes, or other thermoplastics. Suitable fibers include, for example, carbon-based fibers such as graphite, glass fibers, aramid fibers, and extended chain polyethylene fibers. After the successive layers of fiber reinforced resin are wrapped around the mandrel, the shaft 10 is cured in an oven. Curing times and temperatures depend on the polymer used in the composite and are well known to those of skill in the art.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A set of golf club shafts, comprising:

first and second golf club shafts, each golf club shaft including a tip section defining a proximal end and including a tip section wall, the tip section wall defining a thickness and an outer surface, a grip section defining a distal end and including a grip section wall, the grip section wall defining a thickness and an outer surface, the outer surface of the grip section defining a grip section slope, and a main body section extending from the proximal end of the tip section to the distal end of the grip section, defining a longitudinal axis, and including a main body wall defining an outer surface, wherein a first portion of the outer surface of the main body wall extends from the distal end of the grip section to a predetermined location and defines a length and a first slope relative to the longitudinal axis, and a second portion of the outer surface of the main body wall extends from the predetermined location to the proximal end of the tip section and defines a second slope relative to the longitudinal axis, the first slope being different than the second slope and the grip section slope;

wherein the length of the first portion of the main body wall outer surface of the first golf club shaft is less than the length of the first portion of the main body wall outer surface of the second golf club shaft; and wherein the first and second golf club shafts define respective overall lengths and the overall length of the first golf club shaft is greater than the overall length of the second golf club shaft.

2. A set of golf club shafts as claimed in claim 1, further comprising:

a third golf club shaft;

wherein the length of the first portion of the main body wall outer surface of the second golf club shaft is less than the length of the first portion of the main body wall outer surface of the third golf club shaft.

3. A set of golf club shafts as claimed in claim 2, wherein the third golf club shaft defines a respective overall length and the overall length of the second golf club shaft is greater than the overall length of the third golf club shaft.

4. A set of golf club shafts as claimed in claim 1, wherein the outer surface of the main body wall of at least one of the golf club shafts defines a first outer surface diameter adjacent to the distal end of the grip section and a second outer surface diameter at the predetermined location, and the first outer surface diameter is substantially equal to the second outer surface diameter.

5. A set of golf club shafts as claimed in claim 1, wherein the tip section, main body section and grip section of at least one of the golf club shafts together define a shaft length and the first portion of the main body wall outer surface of the at least one golf club shaft defines a length between approximately 5% to 36% of the shaft length.

6. A set of golf club shafts as claimed in claim 1, wherein the first portion of the main body wall outer surface of at least one of the golf club shafts defines a length between approximately 3 inches and 12 inches.

7. A golf club shaft as claimed in claim 1, wherein the outer surface of the proximal end of the tip section of at least one of the shafts defines a first diameter, the outer surface of the distal end of the grip section of the at least one shaft defines a second diameter, and the first diameter is less than the second diameter.

8. A set of golf club shafts as claimed in claim 1, wherein the main body wall of each shaft defines a thickness which decreases at a substantially constant rate from the proximal end of the tip section to the distal end of the grip section.

9. A set of golf club shafts as claimed in claim 1, wherein the outer surface of the tip section of each shaft defines a tip section slope and the tip section slope is different than the second slope.

10. A set of golf club shafts as claimed in claim 1, wherein the proximal end of the grip section of each shaft defines a diameter greater than 0.81 inch.

11. A set of golf club shafts, comprising:

first and second golf club shafts, each golf club shaft including a tip section defining a proximal end and including a tip section wall, the tip section wall defining a thickness and an outer surface, a grip section defining a distal end and including a grip section wall, the grip section wall defining a thickness and an outer surface, the outer surface of the grip section defining a grip section slope, and a main body section extending from the proximal end of the tip section to the distal end of the grip section, defining a longitudinal axis, and including a main body wall defining an outer surface, wherein a first portion of the outer surface of the main body wall extends from the distal end of the grip section to a predetermined location and defines a length and a first slope relative to the longitudinal axis, and a second portion of the outer surface of the main body wall extends from the predetermined location to the proximal end of the tip section and defines a second slope relative to the longitudinal axis, the first slope being different than the second slope and the grip section slope;

wherein the length of the first portion of the main body wall outer surface of the first golf club shaft is less than the length of the first portion of the main body wall outer surface of the second golf club shaft; and wherein the outer surface of the main body wall of at least one of the golf club shafts defines a first outer surface diameter adjacent to the distal end of the grip section and a second outer surface diameter at the predetermined location, and the first outer surface diameter is greater than the second outer surface diameter.

12. A set of golf club shafts, comprising:

first and second golf club shafts, each golf club shaft including a tip section defining a proximal end and including a tip section wall, the tip section wall defining a thickness and an outer surface, a grip section defining a distal end and including a grip section wall, the grip section wall defining a thickness and an outer surface, the outer surface of the grip section defining a grip section slope, and a main body section extending from the proximal end of the tip section to the distal end of the grip section, defining a longitudinal axis, and including a main body wall defining an outer surface, wherein a first portion of the outer surface of the main body wall extends from the distal end of the grip section to a predetermined location and defines a length and a first slope relative to the longitudinal axis, and a second portion of the outer surface of the main body wall extends from the predetermined location to the proximal end of the tip section and defines a second slope relative to the longitudinal axis, the first slope being different than the second slope and the grip section slope;

wherein the length of the first portion of the main body wall outer surface of the first golf club shaft is less than the length of the first portion of the main body wall outer surface of the second golf club shaft; and wherein the tip section wall, grip section wall and main body section wall of at least one of the golf club shafts each comprise a plurality of layers of fiber reinforced resin.

13. A set of golf club shafts, comprising:

first and second golf club shafts, each golf club shaft including a tip section defining a proximal end and including a tip section wall, the tip section wall defining a thickness and an outer surface, a grip section defining a distal end and including a grip section wall, the grip section wall defining a thickness and an outer surface, and a main body section extending from the proximal end of the tip section to the distal end of the grip section, defining a longitudinal axis, and including a main body wall defining an outer surface and a wall thickness which decreases at a substantially constant rate from the proximal end of the tip section to the distal end of the grip section, wherein a first portion of the outer surface of the main body wall extends from the distal end of the grip section to a predetermined location and defines a length and a first slope relative to the longitudinal axis, and a second portion of the outer surface of the main body wall extends from the predetermined location to the proximal end of the tip section and defines a second slope relative to the longitudinal axis, the first slope being different than the second slope;

wherein the length of the first portion of the main body wall outer surface of the first golf club shaft is less than the length of the first portion of the main body wall outer surface of the second golf club shaft; and wherein the grip section of at least one of the golf club shafts defines a grip section slope relative to the longitudinal axis and the grip section slope is greater than the first slope of the at least one golf club shaft.

14. A set of golf club shafts, comprising:

first and second golf club shafts, each golf club shaft including a tip section defining a proximal end and including a tip section wall, the tip section wall defining a thickness and an outer surface, a grip section defining a distal end and including a grip section wall, the grip section wall defining a thickness and an outer surface, the outer surface of the grip section defining a grip section slope, and a main body section extending from the proximal end of the tip section to the distal end of the grip section, defining a longitudinal axis, and including a main body wall defining an outer surface, wherein a first portion of the outer surface of the main body wall extends from the distal end of the grip section to a predetermined location and defines a length and a first slope relative to the longitudinal axis, and a second portion of the outer surface of the main body wall extends from the predetermined location to the proximal end of the tip section and defines a second slope relative to the longitudinal axis, the first slope being different than the second slope and the grip section slope;

wherein the length of the first portion of the main body wall outer surface of the first golf club shaft is less than the length of the first portion of the main body wall outer surface of the second golf club shaft; and wherein the first slope of each shaft comprises a non-zero slope.

* * * * *